United States Patent [19]

Kennedy et al.

[11] Patent Number: 4,539,724

[45] Date of Patent: Sep. 10, 1985

[54] METHOD FOR CONTINUOUSLY TREATING STAPLE LENGTH TEXTILE FIBROUS MATERIALS

[75] Inventors: William J. Kennedy, Spartanburg, S.C.; A. John Beucus, Morganton, N.C.

[73] Assignee: Beu-Tex Corp., Morganton, N.C.

[21] Appl. No.: 646,310

[22] Filed: Aug. 31, 1984

Related U.S. Application Data

[62] Division of Ser. No. 464,616, Feb. 7, 1983, Pat. No. 4,485,644.

[51] Int. Cl.[3] ..... D06B 3/02; D06B 23/00

[52] U.S. Cl. ..... 8/149.1; 8/156

[58] Field of Search ..... 8/149.1, 156; 68/5 D, 68/5 E, 13 R, 22 R, 44, 45, 202

[56] References Cited

U.S. PATENT DOCUMENTS

| | | | |
|---|---|---|---|
| 2,045,755 | 6/1936 | Cohn | 68/202 X |
| 2,513,344 | 7/1950 | McEwen | 8/156 |
| 2,803,125 | 8/1957 | Mesek | 8/156 X |
| 3,038,777 | 6/1962 | Daul et al. | 8/156 |
| 3,314,256 | 4/1967 | Walsh et al. | 68/45 |
| 3,529,446 | 9/1970 | Fleissner | 68/22 R |
| 4,104,019 | 8/1978 | Smith | 68/5 D X |

FOREIGN PATENT DOCUMENTS

| | | | |
|---|---|---|---|
| 2052581 | 1/1981 | United Kingdom | 68/13 R |

*Primary Examiner*—Philip R. Coe

*Attorney, Agent; or Firm*—Luke J. Wilburn, Jr.

[57] ABSTRACT

Method and apparatus for treating continuously moving staple length textile fibrous materials to uniformly apply a liquid treating composition, such as a dye or other chemical thereto, wherein loose staple fibers are temporarily formulated into a web for continous delivery by gravity down a conveying chute into the nip portion of a pair of applicator rollers containing a treating liquid on their surfaces, and wherein the fiber conveying chute and its discharge end are maintained at preferred angles of inclination and distances from the nip of the two applicator rollers to facilitate continuous delivery of the fibers uniformly through the nip portion of the applicator rollers to improve the application of liquid materials thereto. The fibers are thereafter continuously conveyed for heat treatment in loose random staple length form and under compression through a RF energy confined heating tube.

5 Claims, 4 Drawing Figures

METHOD FOR CONTINUOUSLY TREATING STAPLE LENGTH TEXTILE FIBROUS MATERIALS

This is a divisional of co-pending application Ser. No. 06/464,616 filed on Feb. 7, 1983, and now U.S. Pat. No. 4,485,644.

This invention relates to a method for treating continuously moving staple length textile fibrous materials, and, more particularly, to an improved method for uniformly applying a liquid treating composition, such as a dye or other chemical to the staple fibers, and wherein the loose staple fibers are formulated into a web and continuously delivered into and through nip rollers of a liquid applicator unit to uniformly impregnate the fibers with the treating liquid. As used herein, the terms "liquid dye or other chemical" means any dye or other chemical which is in a liquid medium form when applied to the textile fibrous materials.

BACKGROUND OF THE INVENTION

U.S. Pat. No. 4,104,019 discloses apparatus and method for fixation of dyes and other chemicals in textile fibers, however formed or combined, wherein the textile fibrous materials are wetted with dye or other chemicals and are continuously mechanically conveyed through a closely confined tube located between electrodes which create a radio frequency (RF) energy field in the tube. The fibrous material is packed within the tube during its passage therethrough so as to provide a partially self-sealing pressure chamber therein due to generation of steam whereby the rate of reaction of the dye or chemical on the fibers is accelerated.

As shown in FIG. 3 of the patent, loose fibrous materials are continuously conveyed by suitable conveyors to a liquid dye or chemical applicator unit. The fibers are gravitationally delivered by a chute into a liquid padding unit which contains a moving belt having an amount, or level, of liquid dye or chemical thereon. The liquid dye or chemical transfers into the fibrous material as it is fed into the nip portion of a double roller mangle comprising an upper drum and a lower drum over which the belt passes. The pressure of the roller mangle is controlled to express excess dye or chemical from the wetted fibers and obtain a desired wet pick-up, after which the fibers are further continuously directed into an elongate RF energy heating tube where they are compacted during heat fixation.

It is also known in such equipment as described in U.S. Pat. No. 4,104,019 to utilize a fiber-receiving hopper and ram assembly for receiving the wetted fibrous material from the padding unit and delivering the same under compression into the RF heating tube. The hopper has an open top for gravitationally receiving the wetted fibrous material in a continous stream, or flow, into a lower fiber compression chamber which communicates with the RF energy heating tube. A fluid-actuated ram cycles through the hopper compression chamber to compress and pack the fibrous material into and push it through the heating tube. The compressed fibrous material moving through the tube is heated by RF energy to react or fix the dye or chemical on the fibers, and the material leaves the heating tube against the action of a reduced back pressure piston, after which it is washed, dried and collected in suitable manner.

The apparatus and process above described provides the advantages of a continuous dyeing operation utilizing less energy consumption than the conventional discontinous batch dyeing operations heretofore employed in the prior art. Such apparatus and process also permits effective dyeing of textile fibrous materials with lesser amounts of dye liquid than the prior art batch dyeing operations.

As aforementioned, it has been one practice to continuously deliver the loose staple fibers to the liquid dye applicator unit by means of an inclined chute which gravitationally delivers the fibers into contact with viscous liquid dye composition on the moving belt of the dye applicator, after which the fibers pass through the nip of the double roller mangle. This action impregnates the fibers with dye and expresses excess dye from the fibers to obtain the desired dye pick up thereon. With such apparatus, it has been difficult to maintain a continuous flow and uniform distribution of loose staple length fibers through the dye applicator unit, particularly as the fibers pass into and through the viscous liquid dye and the nip of the roller mangle. Discontinuities in the feed of the loose fibers occur and can cause a build up of the fibers at the dye unit which precludes their passage through the mangle rollers. Such a build up of fibers necessitates interruption of the continuous dyeing operation to correct the situation, with corresponding loss of efficiency of the operation. In addition, if the fibers are fed at a non-uniform rate or are not uniformly distributed during their passage through the dye applicator unit, the fibers tend to be non-uniformly impregnated with dye.

One effort directed to alleviating the problem of discontinuous feed and non-uniform application of dye to the fibers on the aforementioned equipment has been the provision of a rotary screen vacuum drum for collecting and condensing the loose fibers in the form of a more cohesive web which is delivered onto a horizontal conveyor and thereafter gravitationally by a chute to the nip rollers and belt of the aforementioned dye applicator unit. Such apparatus and method of handling the fibers to permit improved impregnation of the same during their continuous movement through the applicator unit are described in detail in a copending, commonly assigned U.S. patent application Ser. No. 390,202 filed June 21, 1982, and now U.S. Pat. No. 4,472,850.

BRIEF OBJECTS OF THE INVENTION

It is an object of the present invention to provide further an improved method of the type described for the high speed, continuous treatment of textile staple length fibrous materials which further facilitates effective and uniform impregnation of the moving materials with desired amounts of liquid dye or other chemical.

It is a more specific object to provide an improved method for dyeing or otherwise chemically treating continuously moving textile staple fibers wherein fibers are formed during their continuous conveyance into a web of increased cohesive integrity, and, by use of a particularly oriented and located gravity feed device, can be effectively passed continuously and in uniform distribution through a dye or chemical nip roller applicator unit for uniform impregnation with a liquid composition.

SUMMARY OF THE INVENTION

The invention comprises an improvement in a method for the continuous treatment of textile staple length fibrous materials, wherein the loose fibers temporarily are combined in a web form for introduction into and continuous passage through a treating liquid applicator unit having a dye or other chemical liquid supply source and nip rollers for applying accurate amounts of liquid dye or chemical to the fibers. The liquid-impregnated web of fibers leaving the applicator unit is separated into discrete smaller portions of fiber mass and forced under compression through a continuous elongate high frequency energy heating tube for fixation of the dye or chemical therein.

More specifically, loose staple length fibers which have been formed into a web are delivered gravitationally from the web-forming unit by way of an inclined chute to pass into the nip of a pair of driven rollers of the applicator unit. The nip rollers are rotatable about horizontal axes disposed in a common vertical plane. The surfaces of both rollers contain a treating liquid for application to the fibers. The inclined delivery chute is so configured and its delivery end is so positioned relative to the nip of the rollers that the fibers are uniformly and continuously delivered into and through the nip of the liquid coated rollers, permitting more uniform and complete impregnation of all the fibers for subsequent processing.

BRIEF DESCRIPTION OF THE DRAWINGS

The above as well as other objects of the present invention will become more apparent, and the invention will be better understood from the following detailed decription of a preferred embodiment thereof, when taken together with the accompanying drawings, in which.

DETAILED DESCRIPTION OF THE PREFERRED EMBODIMENTS OF THE INVENTION

Figure 1:
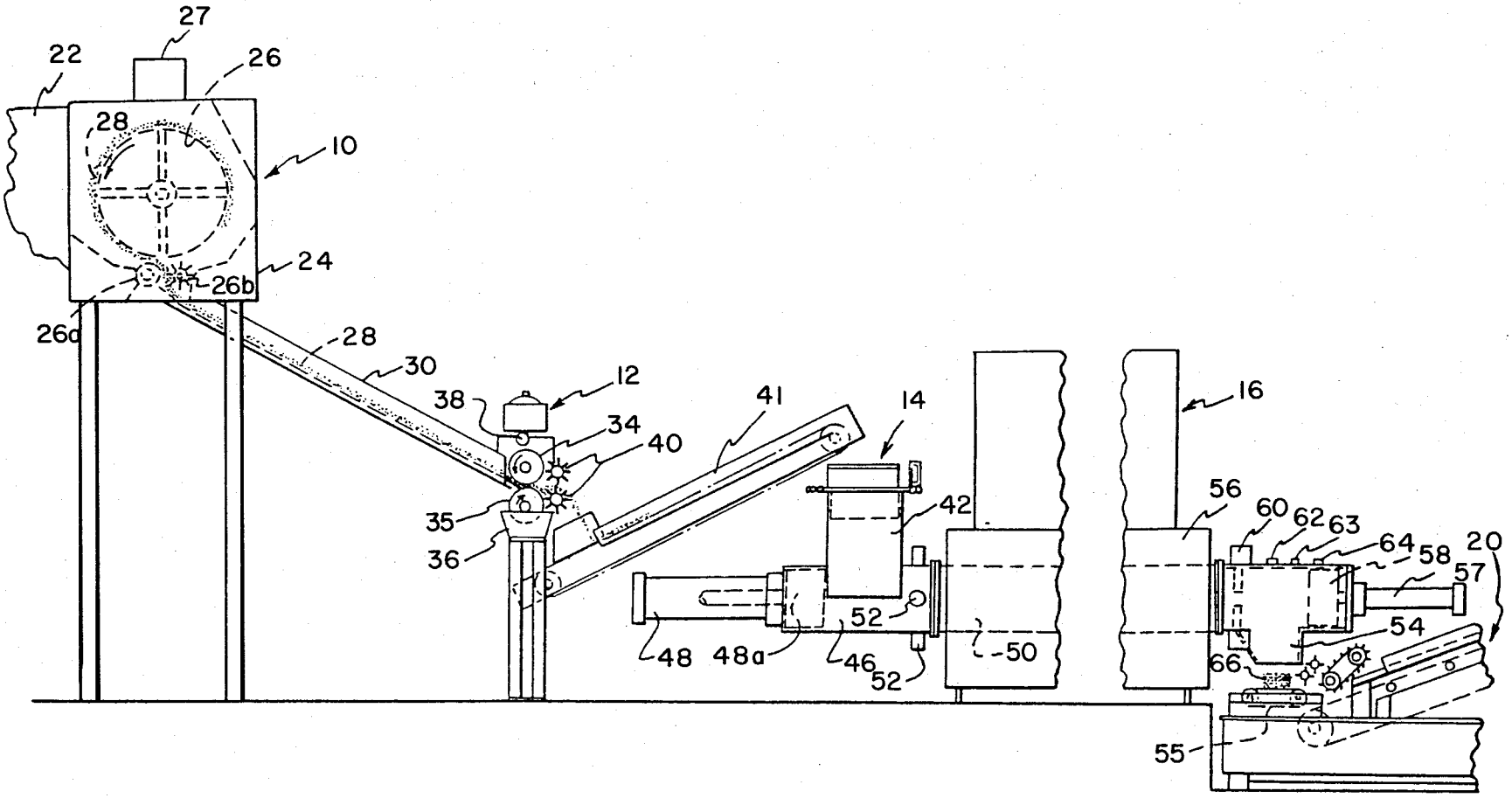
FIG. 1 is a schematic side elevation view of apparatus for the treatment of continuously moving textile fibrous material by the application of liquid compositions of dye or other chemicals, with subsequent heat fixation of the same thereon by passage under compression through a confined high frequency energy heating tube.

Referring more specifically to the drawings, FIG. 1 shows improved apparatus of the present invention for treating continuously moving textile fibrous material. Basically, the treatment apparatus includes a textile fibrous material supply and condensing section 10, a liquid applicator section 12, a fibrous material compression section 14, a high frequency energy heating tube section 16, and a washing section 20.

Textile fibrous material, typically in the form of loose staple length fibers, is pneumatically conveyed by way of a delivery tube 22 from a suitable supply source, such as conventional textile opening and weigh pan blending equipment (not shown), into a fiber condenser unit 24 containing a rotating filter drum 26. The surface of the drum is perforous and the interior of the drum is suitably connected by way of a conduit through a side wall of the unit to a vacuum source, such as a motorized fan in a housing 27 which draws the fibers into the unit 24 to form a condensed fibrous batt or web 28 on the filter drum outer surface. The drum is mounted on a support shaft 29 suitably connected to a drive motor (not shown) and is continuously rotated in the direction indicated by the arrow to convey the web of randomly oriented fibers under a pressure roller **26*a* for removal from the drum surface by a flexible bladed doffing roller 26*b*. The web 28 which has increased cohesive integrity is deposited directly from the condenser unit 24 onto an inclined conveyor chute 30. The condenser unit 24** is of a type air filter unit manufactured by Continental Conveyor and Equipment Co. of Sherman, Texas under the trademark "Fibr-A-Filter II". Details of construction of such units are known in the textile industry. Typically such equipment is employed to filter contaminants from the air in processing areas of textile manufacturing plants.

The chute 30 has a flat smooth conveying surface and is downwardly inclined so that its discharge end 32 is disposed immediately adjacent the nip of a pair of nip rollers 34, 35 of a liquid dye or chemical applicator unit of applicator section 12. The amount of fiber supplied to the liquid applicator unit is controlled by varying the rate of supply of loose fiber to condenser unit 14 from the opening and blending equipment. Suitable motor means, e.g., DC drive motors, (not shown) are operatively connected in conventional manner to positively drive the various conveyors and rollers for continuous delivery of fibers through the treating range.

Figure 2:
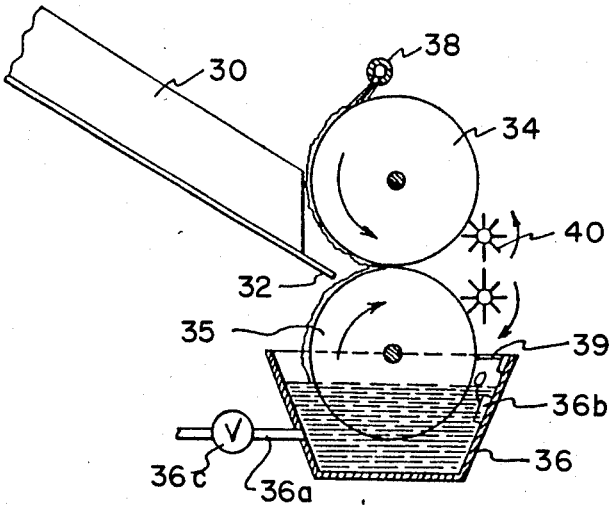
FIG. 2 is an enlarged schematic side elevation view of the inclined conveyor chute and the liquid applicator unit of the apparatus of FIG. 1, with portions thereof in section, to better show the disposition of the lower delivery end of the chute relative to the nip rollers of the applicator unit.

As best seen in FIG. 2, the applicator unit of section 12 includes a pan 36 for containing a treating liquid, typically a liquid dye composition. The liquid dye composition is supplied to the pan by a supply conduit **36*a* and the level of the liquid in the pan is controlled in known manner by a float controller 36*b* connected to valve means 36*c* in conduit 36*a***.

The nip rollers 34, 35 are mounted for rotation about horizontal axes disposed substantially in a common vertical plane. The lower roller 35 is driven by suitable motor means (not shown) and its lower portion is located in pan 36 so that it picks up and conveys liquid dye composition upwardly from the pan into the nip portion of the two rollers to contact and impregnate the fiber web as it is delivered from the end 32 of chute 30 into the nip of the rollers. Similarly, a metered amount of the liquid dye composition is supplied uniformly across the upper surface of upper nip roller 34 from a dye supply manifold 38 and is carried downwardly on the roller surface into the nip for contact with the fibers passing therethrough. A desired pressure is applied in conventional manner to the rollers 34, 35 to express liquid dye uniformly into and from the fibers to obtain a desired amount of wet dye pickup in the fibers. The dye-impregnated fibers are removed from the surface of the rollers by two rubber bladed scraper rollers 40. A doctor blade 39 prevents the fibers from falling into pan 36, and the fibers are deposited in broken apart, smaller masses of fibers onto a continuously moving inclined conveyor 41.

The wetted loose fibrous material impregnated with a desired amount of dye liquid is continuously gravitationally delivered by conveyor 41 into the upper end of a fiber-receiving hopper 42 of the fiber compression section 16. Hopper 42 has a generally rectangular upper opening in which is disposed a pair of pivotably mounted fiber collector plates communicating with lower fiber compression chamber 46. The compression head 48*a* of a double-acting hydraulic ram assembly 48 moves through the compression chamber in a generally horizontal direction to compress the fibrous material received in the chamber and push the same into an elongate confined radio-frequency energy heating tube 50. A plurality of hydraulic piston-actuated, fiber-retaining pins 52 are arcuately disposed about the inlet of heating tube 50 and are arranged and operated to move radially into the fiber passageway to retain compressed fiber in the heating tube 50 against backward movement into the compression chamber 46 each time ram head 48*a* is retracted for the beginning of another compression stroke.

The compressed fibers passing through tube 50 are heated by conventional RF energy generating equipment, which includes an H.T. transformer, rectifier, tube oscillator, and tank circuit adjustable to give a radio frequency of 27.12 megahertz. The generating equipment, details of which are known in the art and are not shown in FIG. 1, are located in an insulated protective housing 56. The RF energy imparted to the dye-impregnated, compacted fibers in tube 50 raises the temperature in the fibrous material to a desired degree to set and/or otherwise fix the dye on the fibers, as by ionic bonding of the dye molecules to the fiber molecules.

As best seen in FIG. 1, the exit end of the heating tube 50 has a downwardly disposed fiber outlet 54 for discharging fibers onto a moving conveyor 55. Disposed in the exit end portion of heating tube 50 to control periodic discharge of compressed fiber mass sections from the tube is a pneumatic piston 57 with pressure head 58 and a plurality of pneumatic piston-actuated, fiber-retaining pins 60. Pistons of the pressure head 58 and retaining pins 60 are of the double-acting type and connected through conventional control valves, pressure regulator, and supply lines to a source of pressurized air (not shown). The exit piston pressure head 58 is arranged to move horizontally through the end portion of the heating tube over outlet 54, and located in its path of travel are three switches 62, 63, 64 which are connected to actuate the pneumatic control valves and supply pressurized air to the exit piston and pin pistons in the following sequence.

Compressed fiber mass sections 66 are periodically discharged from the heating tube in the following cycle. When the exit piston pressure head 58 is fully extended into the exit end of the heating tube to close the tube passageway and contact switch 62, pressure regulated air is supplied to the exit piston 57 to maintain a constant counter pressure of the pressure head against the compressed fibers in the tube. Pressurized air is also supplied to the pistons of pins 60 to fully retract the pins from the heating tube passageway. As fiber pressure builds in the heating tube due to the compressing action of the main compression ram assembly 48, the exit piston pressure head 58 is pushed outwardly of the tube by the moving fiber mass, to the right as seen in FIG. 1, until it contacts switch 63. Switch 63 actuates the air control valves to supply pressurized air to the pistons of pins 60 to insert the pins into the heating tube passageway and thereby retain the fibers under compression in the tube upstream of the pin positions. Pressurized air is also supplied to the exit piston 57, after momentary time delay, to move the pressure head 58 quickly further outwardly of the exit end of the heating tube, thereby releasing the section of compacted fibers between the pins and pressure head which falls by gravity through the heating tube outlet 54 and onto the conveyor 55. When the pressure head 58 contacts switch 64, pressurized air is supplied to the exit piston 57 to return the pressure head back to its innermost position to contact switch 62 and close the tube outlet 54. Contact of the pressure head with switch 62 directs compressed air to again retract the fiber-retaining pins 60 from the heating tube passageway and establish a constant counter pressure of the pressure head 58 on the fibers for the beginning of another discharge cycle.

Sections 66 of released fibrous material which gravitationally fall from exit outlet 54 of the tube are conveyed by suitable conveyor sections through washing section 20, after which they are dried and collected in suitable manner (not shown).

In dyeing fibers utilizing RF energy to fix or react the dye with the fibers, it is extremely important that the dye composition be uniformly distributed throughout the fibrous materials during impregnation at the dye applicator unit. If the fibers are not continuously fed at a uniform rate and distribution through the nip portion of the applicator rollers 34, 35 of the unit, the dye liquid will consequently be non-uniformly applied to the fibers. Non-uniform impregnation of the fibers results, in some instances, in undyed fibers and in a non-uniform packing density of fibers in the RF energy heating tube. Such non-uniformities cause consequent non-uniform fixation of the dye to the fibers.

The web of individual fibers delivered to the applicator unit therefore must maintain its longitudinal continuity and uniformity during passage through the liquid dye composition and applicator rollers 34, 35, while still permitting the web to be separated easily into smaller fiber portions by the bladed scraper rollers 40 before introduction into the hopper unit compression chamber 46 for compaction into heating tube 50.

Figure 3:
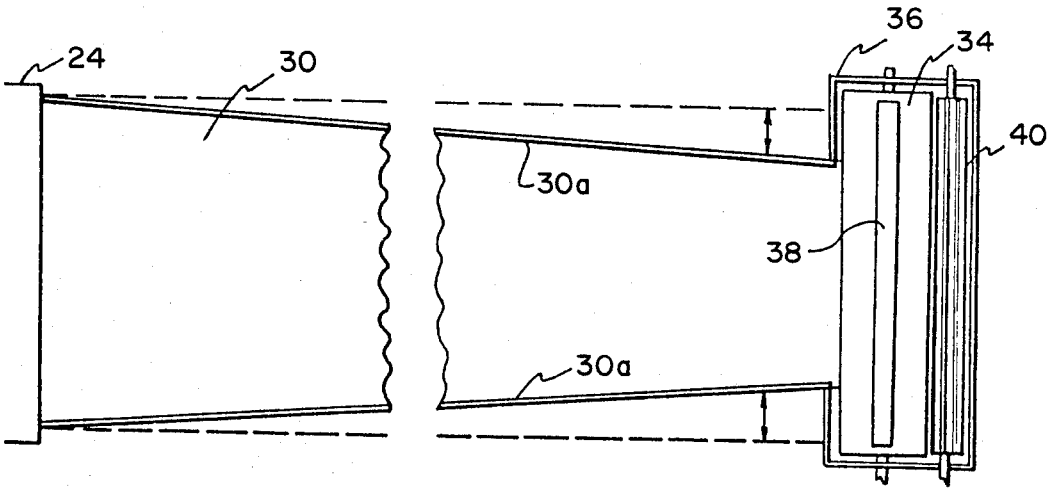
FIG. 3 is a plan view of the conveyor chute and applicator unit of FIG. 2.

The air pressure differential in the fiber condenser unit 24 draws the staple length fibers in a generally random orientation onto the filter drum surface to dispose them in a more cohesive web form. To facilitate uniform feed of the fiber web through the nip rollers of the dye applicator unit, gravity feed chute 30 has vertical side walls 30*a* which may be adjusted to provide an inward taper (FIG. 3) to reduce the width of the web as it slides down the flat chute surface to the nip rollers 34, 35. In a preferred embodiment, the fiber support surface of chute 30 having a length of 62 inches tapers, or narrows, approximately 20%, e.g., from 53 inches at the condenser discharge outlet to 43 inches at the nip rollers, to laterally condense the width of the web. The downwardly tapered feed chute 30 thus aids in accumulating the web at the lower portion of the chute to ensure continuity of web feed through the nip rollers 34, 35, in the event that a transverse break occurs in the web passing down the chute surface.

To maintain a continuous flow of fibers through the nip of the dye applicator rollers with uniform fiber distribution in both longitudinal and transverse direction of web movement, it has also been found that the location of the conveyor chute relative to the nip rollers of the liquid applicator units preferably should be maintained within certain defined limits, as hereinafter described. More specifically referring to FIG. 4, which is a side elevation depiction of the nip rollers and the lower end of the conveyor chute, as viewed in a vertical plane parallel to movement of the web, the conveyor chute 30 must be inclined at an angle which causes the fiber web to slide down the surface of the chute in a generally continuous manner. For a conveyor chute having a smooth Teflon® paper-coated surface, this angle for most fiber types has been found to be preferably approximately 30 degrees from the horizontal, as shown by the angle in FIG. 4. With dye applicator rollers 34, 35 positioned with their horizontal rotational axes in a common vertical plane, the discharge end 32 of the conveyor chute 30 should remain within an arcuate area A adjacent the lower roller surface bounded by (1) an extension of a radius line $R_1$ of the lower roller 35 which defines an angle of approximately 20 degrees with a horizontal plane through the axis of rotation of the lower roller, (2) an extension of a radius line $R_2$ of the lower roller 35 which is tangent to the circumferential surface of the upper nip roller 34, and (3) a radial distance from the surface of lower roller 35 which is no greater than the approximate thickness of the fiber web at its point of introduction into the nip portion of the two nip rollers of the dye applicator unit. Such web thickness may be measured by use of a calibrated distance indicator positioned on and extending normal to the surface of the chute 30 at its discharge end 32.

Figure 4:
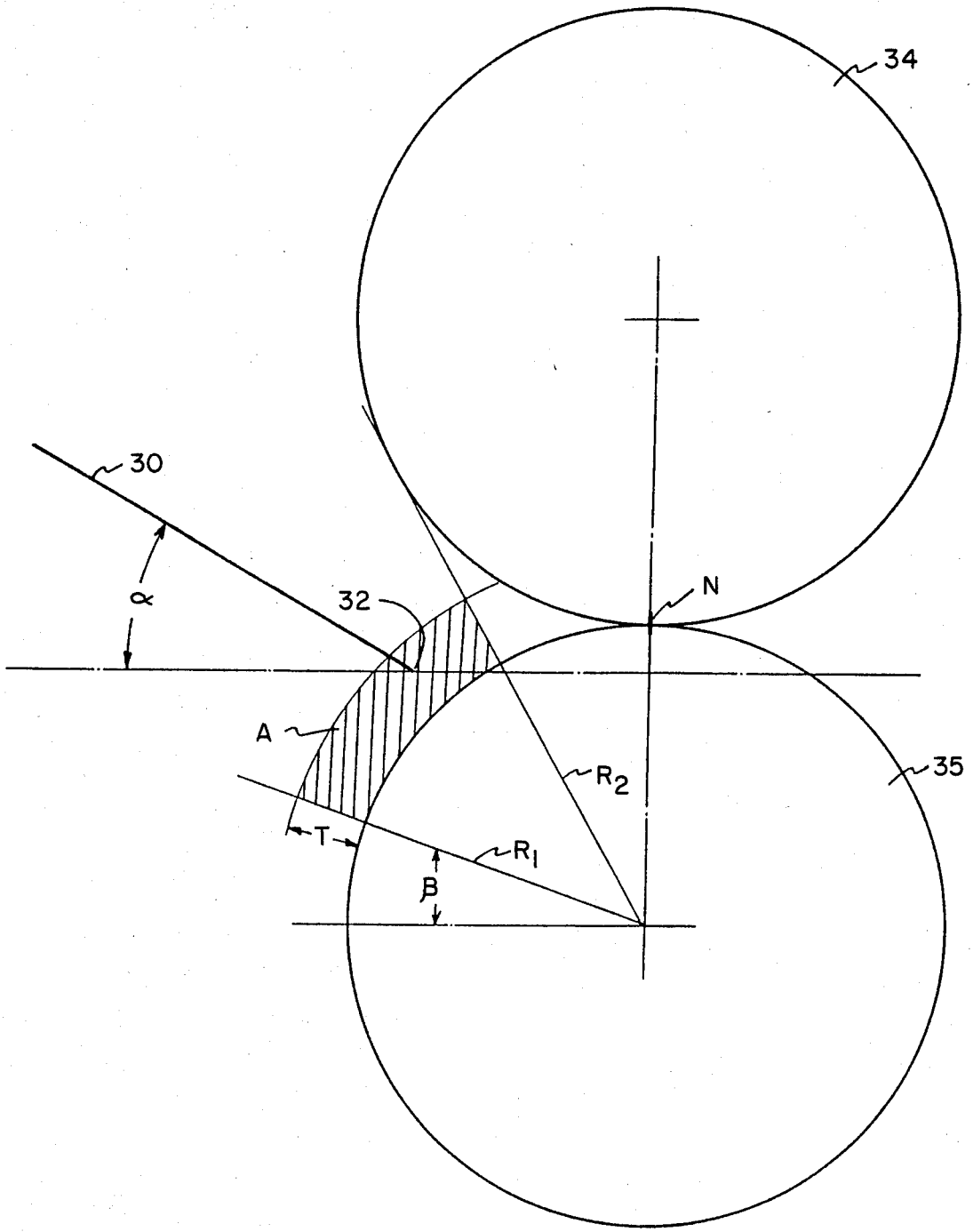
FIG. 4 is a diagrammatic side elevation view illustrating the lower end of the conveyor chute relative to the applicator rollers of the liquid applicator unit.

Additionally within the aforementioned area A shown in FIG. 4, the discharge end of the chute should be a sufficient distance from the surface of the lower roller 35 to permit the treating liquid carried thereon to pass upwardly to the nip N without contacting the end of the chute. For most liquid dye compositions, it has been found that a distance of about ½ inch between the end of the chute and the surface of roller 35 is sufficient to permit passage of the viscous dye liquid on the surface of the roller without contact with the end of the chute.

By maintaining the chute so positioned, as the fibers reach the end of the chute 30, they make contact with the roller surfaces 34, 35 to be drawn by rotation of the surfaces and the liquid materials carried thereon into the nip portion of the rollers. Experimentation has shown that when the position of the discharge end of the chute lies further from the lower roller surface than the approximate thickness of the web being fed into the nip portion of the rollers, the web tends to fall from the chute downwardly and not be effectively carried into the rollers. In like manner when the discharge end 32 of the chute is above an extended radius $R_2$ of the lower roller which is approximately tangent to the surface of the upper roller 35, the web will be bunched up, slip, and not be carried into the nip portion for expression of liquid therefrom.

Within the above described parameters, and employing two applicator rollers of 16 inch diameter and a Teflon-coated conveyor chute surface, excellent results have been obtained for most fiber types by employing an angle of inclination (FIG. 4) of the chute 30 of about 30°, and with the end 32 of the chute located about ½ inch from the surface of roller 35 and about 2 ⅜ inches from the nip N of the rollers for a web thickness T of from about 2 to 5 inches at the discharge end of the chute. With such an arrangement as described, using a web linear discharge rate from the condenser unit of 29 feet per minute, and nip rollers 34, 35 driven at a linear surface speed of 33 feet per minute, the fiber web is caused to accelerate during its initial movement down a first portion of the length of the chute 30, thus ensuring that the web does not accumulate on the upper end of the chute and fail to move down the chute continuously under influence of gravity. Thereafter, the longitudinal speed of the web is caused to decelerate due to the downwardly tapered sides of chute 30 to accumulate on a lower portion of the chute before its passage into contact with the liquid dye composition on the nip rollers 34, 35 and through the nip portion of the rollers to ensure continuity of feed across the gap between chute discharge end and nip of the rollers. The thickness of the web is increased during its accumulation at the lower portion of the chute.

The present invention may be better illustrated by the following specific examples of the conditions of operation of the apparatus described and shown herein, and utilizing the fiber gravity conveying chute and dye applicator unit of the present invention to provide a continuous and uniform feed of fibers through the dye unit.

EXAMPLE I

Loose 1 ⅛ inch 3 denier staple length Acrilan acrylic fibers are continuously pneumatically conveyed into the fiber condenser unit 24 at a rate of 1,050 pounds per hour from fiber opening and weigh pan blending equipment. Suction from the fan 27 of the condenser unit draws the loose fibers onto the surface of the rotating filter drum 26 where they deposit themselves in a randomly oriented fashion to form a fibrous web. The filter drum is operated to deliver the web of fibers downwardly and directly onto the upper end of the inclined conveyor chute 30 at a linear delivery rate of 29 feet per minute and with a web thickness of about 2 inches. The web slides down the chute, which has a coated Teflon® surface, under its own weight at an initial acceleration so as to occasionally separate transversely of its direction of travel. The nip rollers 34, 35 of the applicator unit 12 are operated at a surface speed of about 33 feet per minute.

The conveyor chute is inclined downwardly at an angle of 30° to the horizontal and tapers inwardly from a width of 53 inches at its upper end to 43 inches at its lower delivery end into the dye applicator unit 12. The delivery end of the chute 30 is located about 2 ⅜ inches from the nip of the rollers 34, 35, and about ½ inch from the surface of the lower roller 35, as measured in the longitudinal plane of the conveyor. The discharge end of the chute is positioned slightly below a horizontal plane through the nip of the two rollers 34, 35.

The taper of the delivery chute reduces the width of the fiber web to condense and accumulate a length of the same on the lower portion of the chute. This ensures continuous delivery of fibrous material to the nip rollers of the dye applicator. The web thickness at the top of the delivery chute was 2 inches and at the bottom of the chute had been accumulated to a thickness of 5 inches.

A suitable amount of viscous liquid dye composition is delivered continuously from the dye pan 36 into the nip of the rollers on the surface of roller 35 and a metered amount of the dye composition also is delivered continuously to the nip by way of dye manifold 38 and the surface of upper roller 34. The rollers are set to apply a desired pressure, in conventional manner, to obtain wet pick-up of dye of approximately 100% based on dry fiber weights.

The dye-impregnated fibrous material leaving the exit of the nip of the mangle rollers is contacted by bladed scraper rollers 40 which break the fiber web apart into discrete small loose fiber sections for delivery onto inclined conveyor 41. The wet fibers are continuously delivered into fiber hopper 42 where they are compressed by ram 48 into and through the RF energy heating tube 50. The compressed and compacted fibers are heated in the heating tube to react and fix the dye therewith. Compressed fiber sections are periodically discharged from the exit end of the heating tube onto horizontal conveyor 55. The fibers are conveyed through washing section 20 where they are continuously washed, and thereafter dryed and collected.

Measurements in the velocity of the fiber web passing down the conveyor chute were made by timing movement of the web at 10 inch intervals along the length of the chute. The results of such measurements are expressed in the following chart as velocity (V) between successive 10 inch interval points 1–4 and the nip (n) of the rollers 34, 35, as follows:

Acrilan ® Fibers $V_{condenser}$=29 ft. per min.
$V_{1,2}$=41 ft. per min.
$V_{2,3}$=33 ft. per min.
$V_{3,4}$=29.5 ft. per min.
$V_{4,n}$=28.8 ft. per min.
$V_{nip}$=33 ft. per min.

The fibers processed under the above stated conditions, by observation, were uniformly impregnated with the dye composition at the dye applicator unit and were continuously fed by the conveyor chute through the nip rollers of the unit without break in the continuity of the same. The fibers were subsequently heated, washed, dried and collected, and exhibited uniform fixation of the dye throughout the fiber mass collected.

EXAMPLE II

Loose ½ inch 20 denier staple length Verel ® modacrylic fibers were continuously processed in accordance with the conditions of Example I with the conveyor chute positioned as specified therein for delivery of the fibers to the dye applicator unit. The web thickness at the top of the delivery chute was 1 ½ inch and at the bottom of the chute before passage into the nip rollers was measured as 4 inches in thickness.

Measurements in the velocity of the fiber web passing down the conveyor chute were made in accordance with Example I and are presented in the following chart:

Verel ® Fibers $V_{condenser}$=29 ft. per min.
$V_{1,2}$=49 ft. per min.
$V_{1,3}$=40.3 ft. per min.
$V_{2,4}$=38.5 ft. per min.
$V_{3,4}$=35.7 ft. per min.
$V_{4,n}$=32 ft. per min.
$V_{nip}$=33 ft. per min.

The fibers so processed, after heat setting, washing, drying and collection exhibited uniform dye fixation throughout the fiber mass.

That which is claimed is:

1. In a method of treating staple length fibers to dye or otherwise chemically treat the same while continuously transporting the fibers in a predetermined path of travel to a point of collection, and including the steps of continuously delivering a metered amount of the fibers in generally loose random form, condensing the loose fibers into a web to increase their cohesion to each other, passing the web into and through a pair of nip rollers of a dye or chemical liquid composition applicator to impregnate the fibers with the liquid composition and express excess liquid therefrom, breaking up the web into smaller discrete fiber masses, and heating the moving liquid-impregnated fibers in a confined zone with high frequency energy while the fibers are maintained under compression to react the dye or other chemical with the fibers before their collection; the improvement comprising the step of gravitationally delivering the fiber web to the nip rollers while continuously applying the liquid composition to the surface of the rollers to carry the composition into contact with the web of fibers passing through the nip, supportably contacting the web in its gravitational movement to the nip rollers while reducing the width of the web to further condense and accumulate the same, and passing the web continuously through an unsupported zone immediately before passage into and through the nip.

2. An improved method for uniformly impregnating staple length textile fibers while continuously moving the fibers in a desired path of treatment to a point of collection comprising the steps of continuously conveying a metered amount of loose fibers along said path, temporarily condensing the fibers into a web form to increase their cohesive integrity, passing the web under influence of gravity downwardly over a smooth fixed support and through and unsupported zone surface immediate for introduction into the nip of a pair of nip rollers having horizontal rotational axes disposed in a common vertical plane and carrying a treating liquid on their surfaces to impregnate the fibers, initially accelerating the speed of the condensed web in its downward movement and thereafter decelerating the speed of the web during its movement over the lower portion of the fixed support surface to further condense the same and ensure its longitudinal continuity as it passes from the support surface into the treating liquid and the nip portion of the rollers, breaking up the liquid impregnated fiber web exiting the rollers, and further treating the moving impregnated fibers before their collection.

3. A method as defined in claim 2 including the step of maintaining the fixed support surface at an angle of approximately 30 degrees to the horizontal to facilitate movement of the fiber web downwardly over the support surface and through the nip portion of the liquid applicator rollers.

4. A method as defined in claim 2 wherein the lower end of the support surface is maintained during delivery of the fiber web to the nip of the liquid applicator rollers with an area bounded by (1) an extended radius of the lower roller which defines an angle of approximately 20° with a horizontal plane through the axis of rotation of the lower roller,
(2) an extended radius of the lower roller which is tangent to the upper roller peripheral surface,
(3) an arc of a circle which extends between said extended radii, is generated about the axis of rotation of the lower roller, and lies at a distance from the surface of the lower roller which is the approximate thickness of the fiber web at said discharge end of the conveyor chute, and
(4) the surface of the lower roller extending between said extended radii.

5. A method of uniformly impregnating textile staple length fibers which are continuously moving in a desired path of treatment to a point of collection, comprising the steps of (a) continuously delivering a metered amount of loose fibers to said path for movement therealong, (b) temporarily forming the moving fibers into a web to improve their cohesive integrity and uniformity of distribution along said path, (c) passing the web by gravity downwardly over an inclined fixed support surface and through an unsupported zone for immediate delivery into and passage through the nip portion of a pair of rotatably driven liquid applicator rollers having horizontal axes of rotation disposed in a common vertical plane and carrying an amount of treating liquid on their surfaces to impregnate the fibers, (d) continuously discharging the web from the support surface into contact with the treating liquid and through the nip portion of the applicator rollers, and (e) breaking up the fiber web exiting the applicator rollers for further processing of the loose fibers before their collection.

* * * * *

UNITED STATES PATENT AND TRADEMARK OFFICE

CERTIFICATE OF CORRECTION

PATENT NO. : 4,539,724

DATED : September 10, 1985

INVENTOR(S) : William J. Kennedy and A. John Beucus

It is certified that error appears in the above-identified patent and that said Letters Patent are hereby corrected as shown below:

Claim 2, column 10, line 27, after "support", insert --surface--.

Claim 2, column 10, line 27, after "zone", delete "surface".

Claim 2, column 10, line 28, insert --for-- before "immediate".

Claim 2, column 10, line 28, after "immediate" delete "for".

Signed and Sealed this

*Twenty-sixth* Day of *November 1985*

[SEAL]

*Attest:*

DONALD J. QUIGG

*Attesting Officer*

*Commissioner of Patents and Trademarks*